US008769886B2

(12) United States Patent
Ohnishi et al.

(10) Patent No.: US 8,769,886 B2
(45) Date of Patent: Jul. 8, 2014

(54) BUILDING UNIT WITH TEMPORARY REINFORCING MEMBERS, UNIT BUILDING, AND METHOD FOR CONSTRUCTING UNIT BUILDING

(75) Inventors: Katsunori Ohnishi, Tokyo (JP); Akihiko Kobayashi, Tokyo (JP); Satoshi Saigo, Tokyo (JP); Hai Lin, Tokyo (JP)

(73) Assignees: Sekisui Chemical Co., Ltd., Osaka (JP); Studio Cube, Inc., Tokyo (JP); Arcadia Co., Ltd., Tokyo (JP)

( * ) Notice: Subject to any disclaimer, the term of this patent is extended or adjusted under 35 U.S.C. 154(b) by 143 days.

(21) Appl. No.: 13/121,504

(22) PCT Filed: Sep. 28, 2009

(86) PCT No.: PCT/JP2009/066719

§ 371 (c)(1),
(2), (4) Date: May 31, 2011

(87) PCT Pub. No.: WO2010/035816

PCT Pub. Date: Apr. 1, 2010

(65) Prior Publication Data

US 2011/0219708 A1 Sep. 15, 2011

(30) Foreign Application Priority Data

Sep. 29, 2008 (JP) ..... 2008-250545

(51) Int. Cl.

| | |
|---|---|
| ***E04H 1/00*** | (2006.01) |
| ***E04H 3/00*** | (2006.01) |
| ***E04H 5/00*** | (2006.01) |
| ***E04H 6/00*** | (2006.01) |
| ***E04H 9/00*** | (2006.01) |
| ***E04H 14/00*** | (2006.01) |
| ***E04B 1/348*** | (2006.01) |

(52) U.S. Cl.

CPC ..... *E04B 1/3483* (2013.01); *E04B 1/34869* (2013.01); *Y10S 52/12* (2013.01)

USPC ..... 52/79.12; 52/638; 52/143; 52/71; 52/125.2; 52/79.13; 52/146; 52/DIG. 12

(58) Field of Classification Search

USPC ..... 52/745.16, 745.13, 79.1, 745.02, 71, 52/13, 657, 79.5, 79.8, 79.9, 79.12, 79.13, 52/146, DIG. 12; 294/67.1, 68.1, 81.1

See application file for complete search history.

(56) References Cited

U.S. PATENT DOCUMENTS 3,182,424 A * 5/1965 Betjemann ..... 52/69
3,530,982 A * 9/1970 Bigelow, Jr. ..... 206/321

(Continued)

FOREIGN PATENT DOCUMENTS

JP 7-62745 3/1995
JP 7-100975 11/1995

(Continued)

OTHER PUBLICATIONS

Chinese Office Action issued Jan. 26, 2011 in corresponding Chinese Patent Application No. 200980000444.2.

*Primary Examiner* — Chi Q Nguyen

(74) *Attorney, Agent, or Firm* — Wenderoth, Lind & Ponack, L.L.P.

(57) ABSTRACT

When constructing a unit building having a middle scale or more such as especially an apartment house, a long and large size building unit capable of reducing construction period while increasing construction efficiency and being economically provided can be achieved.

Detachable temporary reinforcing members 2 are provided on both of the short side surfaces of the building unit body 1A, respectively. The temporary reinforcing member 2 has lower end portion on which a projecting portion 3 is downwardly projected.

20 Claims, 19 Drawing Sheets

(56) References Cited

U.S. PATENT DOCUMENTS

| | | | | | |
|---|---|---|---|---|---|
| 3,792,558 | A * | 2/1974 | Berce et al. | 52/79.7 |
| 5,193,325 | A * | 3/1993 | Allison | 52/745.02 |
| 5,403,055 | A * | 4/1995 | Allison | 294/67.1 |
| 5,447,000 | A * | 9/1995 | Larsen | 52/79.1 |
| 5,661,930 | A * | 9/1997 | Porter | 52/64 |
| 5,706,614 | A * | 1/1998 | Wiley et al. | 52/79.1 |
| 5,735,639 | A * | 4/1998 | Payne et al. | 405/129.57 |
| 6,016,634 | A * | 1/2000 | Sayer | 52/648.1 |
| 6,463,705 | B1 * | 10/2002 | Davis et al. | 52/143 |
| 7,827,738 | B2 * | 11/2010 | Abrams et al. | 52/79.1 |

FOREIGN PATENT DOCUMENTS

| | | |
|---|---|---|
| JP | 2004-346705 | 12/2004 |
| WO | 2005/038155 | 4/2005 |
| WO | 2007/033498 | 3/2007 |

* cited by examiner

BUILDING UNIT WITH TEMPORARY REINFORCING MEMBERS, UNIT BUILDING, AND METHOD FOR CONSTRUCTING UNIT BUILDING

TECHNICAL FIELD

The present invention relates to a building unit, a unit building configured by the building units, and a method for constructing the unit building.

BACKGROUND ART

Conventionally, it is disclosed that a building having a middle-scale or more such as an apartment house is constructed by assembling a plurality of building units (see Patent Document 1, etc).

As the building unit, a short and small size building unit capable of being stably loaded on a loading platform of a midsize truck as a transport means is used.

That is, conventionally, a unit building constructed by assembling a long and large size building units has not been known.

PRIOR ART DOCUMENTS

Patent Document

Patent Document 1: Japanese Patent Application Publication No. 2004-346705

SUMMARY OF INVENTION

Problems to be Solved by the Invention

If, in order to increase construction efficiency and reduce a construction period, long and large size building units are transported at all, the length is, at a maximum, equal to a length of the loading platform, except for gooseneck parts, of a semi-trailer for a container as the transport means in accordance with, for example, Road Traffic Act which is a strict Japanese law.

However, this length is not sufficient for a building such as an apartment house, and the like, including a plurality of rooms, passages, and the like. Accordingly, as a result, the unit building is required to be constructed by using a large number of shorter building units and therefore construction efficiency cannot be increased to reduce a construction period.

Furthermore, if the long and large size building units are produced abroad and transported by sea at all, plural building units are required to be loaded up when being temporarily-located on land or in an inboard barn during transport by sea. Accordingly, even in a case where each building unit has the same size, it is necessary to unnecessarily increase a thickness of columns of the building units to cause diseconomy.

An object of the present invention is to provide a long and large size building unit, a unit building constructed by the building units, and a method for constructing the unit building, in which it is possible to increase construction efficiency and reduce a construction period, and it is not necessary to increase a thickness of columns when constructing the unit building especially having a middle-scale or more such as an apartment house and which are economically achieved.

Means for Solving the Problems

In order to achieve the object, a building unit according to the present invention with temporary reinforcing members, includes a building unit body having short side surfaces, the temporary reinforcing member being detachably provided on both short side surfaces. The temporary reinforcing member has a lower end portion on which a projecting portion downwardly projected and configured to support the building unit body is provided.

It is preferable that the temporary reinforcing member has a hook portion for hoist.

It is preferable that the temporary reinforcing member has a hook portion for transport fixation.

It is preferable that the temporary reinforcing member may be formed by reinforcing columns disposed on left and right ends of the short side surface of the building unit body and braces erected between the reinforcing columns.

It is preferable that a reinforcing beam is erected at a position lower than a bottom surface of the building unit body between the reinforcing columns.

It is preferable that a hook portion for hoist is formed on an upper end portion of the reinforcing column.

It is preferable that a hook portion for transport fixation is formed on a lower end portion of the reinforcing column.

It is preferable that detachable temporary reinforcing braces are provided at an opening part provided on a long side surface of the building unit body.

It is preferable that a unit building of the present invention is formed by using any of the above described building units and the building unit bodies in a state where the temporary reinforcing members are removed is assembled each other.

It is preferable that plural building unit bodies are horizontally arranged and plural building unit bodies are vertically loaded-up and that the plural building unit bodies are assembled such that connection strength increases as a floor level decreases by combining a composite connections configured to combine between the columns and between the beams in a rigid state and pin connections configured to merely connect therebetween at the short side surfaces.

It is preferable that an overhang member having a width narrower than the short side surface of the building unit body is attached on the short side surface of the building unit body, that a corner outer wall panel is attached on an outwardly directed corner portion of the building unit body, that a decorative member is attached between the overhang member and the outer wall panel and between the overhang members, respectively, and that a vacant space is formed in the decorative members.

An overhang member may be attached on the short side surfaces of the building unit bodies, and a cantilever supported balcony or a cantilever supported passage may be formed by the overhang member.

A first method for constructing a unit building of the present invention includes removing the temporary reinforcing member from any of the above described building units, which is loaded on a loading platform of a transport means, then hosting the building unit body from both of short side surfaces by at least two cranes while maintaining a balance, transferring the building unit body to a predetermined position, and assembling the building unit bodies and thereby constructing the unit building.

A second method for constructing a unit building of the present invention includes hooking, from both of short side surfaces, engagement portions of at least two cranes on the hook portions of any of the above described building units with the temporary reinforcing members, which is loaded on a loading platform of a transport means, hoisting the building unit with the temporary reinforcing members while maintaining a balance, transferring the building unit to a predetermined position, removing the temporary reinforcing members, and then assembling the building unit bodies and thereby constructing the unit building.

Effect of the Invention

Such a building unit with temporary reinforcing members has short side surfaces on which the temporary reinforcing members are detachably provided. The temporary reinforcing member has a lower end portion on which a projecting portion downwardly projected and configured to support the building unit body is provided.

According to the above described configuration, even if the building unit with the temporary reinforcing members has a length over a length from a rear end part of the loading platform to a rear end part of the gooseneck of the semi-trailer for a container as the transport means in accordance with, for example, Road Traffic Act which is a strict Japanese law, the building unit with the temporary reinforcing members is supported at a gooseneck side, that is, a front side of the loading platform of the semi-trailer for a container, on the gooseneck by the beam disposed on the lower side of the short side surface, and supported, at a rear side, on the loading platform by the projecting portions so that the building unit is substantially horizontally supported. Therefore, it is not necessary to provide a notch or the like, which degrades structural durability, on the lower surface of the building unit body so that the building unit can be stably loaded on the loading platform of the semi-trailer for a container.

When constructing a unit building having a middle scale or more such as especially an apartment house, a long and large size building unit capable of increasing construction efficiency to reduce the construction period is achieved.

In transporting process, in a case of the transport by sea, since large load of the building units with the temporary reinforcing members, which have the same size and are loaded up in an inboard barn is borne by the rigid temporary reinforcing members, it is not necessary to unnecessarily increase the thickness of the columns of the building unit body so to be economically achieved.

In the inboard barn, the building unit body is not damaged because the temporary reinforcing members are disposed outside the building unit body to guard the building units. Accordingly, transport can be performed while maintaining high quality.

The temporary reinforcing members are detachable and therefore useful for many occasions and economical.

If the temporary reinforcing member has the hoist hook portion, when the building unit body is hoisted, the hoist hook portion provided on the temporary reinforcing member is used so that the building unit body is not damaged.

If the temporary reinforcing member has the transport fixation hook portion, when the building unit with the temporary reinforcing member is land-transported by the semi-trailer for a container, by fixing the transport fixation hook portions to the engagement holes provided on the loading platform through the twistlock, the building unit body can be land-transported in a stable state without being damaged.

When the building units with the temporary reinforcing members, which have the same size, are loaded up in the inboard barn and transported by sea, a lowermost part of the building units is fixed by hooking the transport fixation hook portions in the engagement hole provided on the floor of the inboard barn through the twistlock. Part loaded on the lowermost part of the building units are fixed by hooking the transport fixation hook portions in the hoist hook holes of the lower building unit through the twistlock. Accordingly, the building unit body can be transported by sea in a stable state without being damaged.

If the temporary reinforcing member is configured such that the braces are erected between the reinforcing columns disposed on both of left and right ends of the short side surface of the building unit body, the temporary reinforcing member has a simple structure in which the reinforcing columns bear a vertical load and the braces bear a horizontal load, so that this can be performed with low cost.

If the reinforcing beam is erected at a position lower than the bottom surface of the building unit body between the reinforcing columns, when the building unit is loaded on the semi-trailer for a container for the land transportation, the building unit body is protected by the reinforcing beam so that the bottom surface of the building unit body is prevented from being damaged by contacting with the gooseneck.

The building unit with the temporary reinforcing members is supported on the gooseneck through the reinforcing beam at a front gooseneck side of the loading platform of the semi-trailer for a container. Accordingly, it is prevented that the beam at the lower side of the short side surface is damaged and that a coating of the beam is removed.

If the hoist hook portion is formed on the upper end portion of the reinforcing column, the building unit with the temporary reinforcing members can be hoisted with a good balance without damaging the building unit body.

If the transport fixation hook portion is formed on the lower end portion of the reinforcing column, the building unit with the temporary reinforcing members can be transported in a stable state without damaging the building unit body.

If the detachable temporary reinforcing braces are provided at the opening part of the long side surface of the building unit body, the opening part of the long side surface of the building unit body and the vicinity thereof, which have strength lesser than the other parts, are reinforced. Accordingly, excess deformation can be suppressed during transport or hoist to maintain quality of the building unit body to be high.

The unit building using any of the above described building units with the temporary reinforcing members has a configuration in that a plurality of building unit bodies in a state where the temporary reinforcing members are removed are assembled. Accordingly, they are not required to be designed with excessively high strength as required for the transportation by sea and therefore may be designed with strength required for the unit building.

Here, four building unit bodies are horizontally arranged and five building unit bodies are vertically loaded up, and these building unit bodies are assembled such that connection strength increases, as the floor level decreases, by combining the composite connections to combine between the columns and between the beams in a rigid state and the pin connections to merely connect therebetween at the short side surfaces. Therefore, required strength for the unit building can be provided while reducing constructing processes.

At the short side surfaces of the building unit bodies, the overhang members each having a width narrower than the short side surface are attached respectively. At the corner parts of the building unit bodies, each directed outwardly, the corner outer wall panels are also attached. Then, between the overhang member and the corner outer wall panel and between the overhang members, the decorative members are attached, respectively. If vacant spaces are formed inside the decorative members, these vacant spaces may be effectively used for a pipe and an air conditioner.

If the overhang member is attached to the short side surface of each building unit body and a cantilever supported balcony or a cantilever supported passage is formed by the overhang member, the cantilever supported balcony or the cantilever supported passage can be provided with simple constructing processes.

The first method for constructing the unit building according to the present invention, is configured by removing the temporary reinforcing members from any of the above described building units, which is loaded on the loading platform of the transport means, and then hoisting the building unit body from both short side surfaces by at least two cranes while maintaining a balance, transferring to a predetermined position, and assembling the building unit bodies to construct the unit building.

Due to such a configuration, when the unit building especially having a medium-scale or more such as an apartment house is constructed, the building unit body can be transferred in a stable state while being substantially horizontally maintained. Accordingly, it is possible to reduce a construction period with high construction efficiency while ensuring safety.

The second method for constructing a unit building of the present invention includes hooking, from both of short side surfaces, engagement portions of at least two cranes on the hook portions of any of the above described building units with the temporary reinforcing members, which is loaded on a loading platform of the transport means, hoisting the building unit with the temporary reinforcing members while maintaining a balance, transferring the building unit to a predetermined position, removing the temporary reinforcing members, and then assembling the building unit bodies and thereby constructing the unit building.

Due to such a configuration, similarly to the first method for constructing the unit building, when the unit building especially having a medium-scale or more such as an apartment house is constructed, the building unit body can be transferred in a stable state while being substantially horizontally maintained. Accordingly, it is possible to reduce construction period with high construction efficiency while ensuring safety.

MODE FOR CARRYING OUT THE INVENTION

Hereinafter, embodiments for carrying out the present invention will be explained with reference to the drawings.

Figure 1:
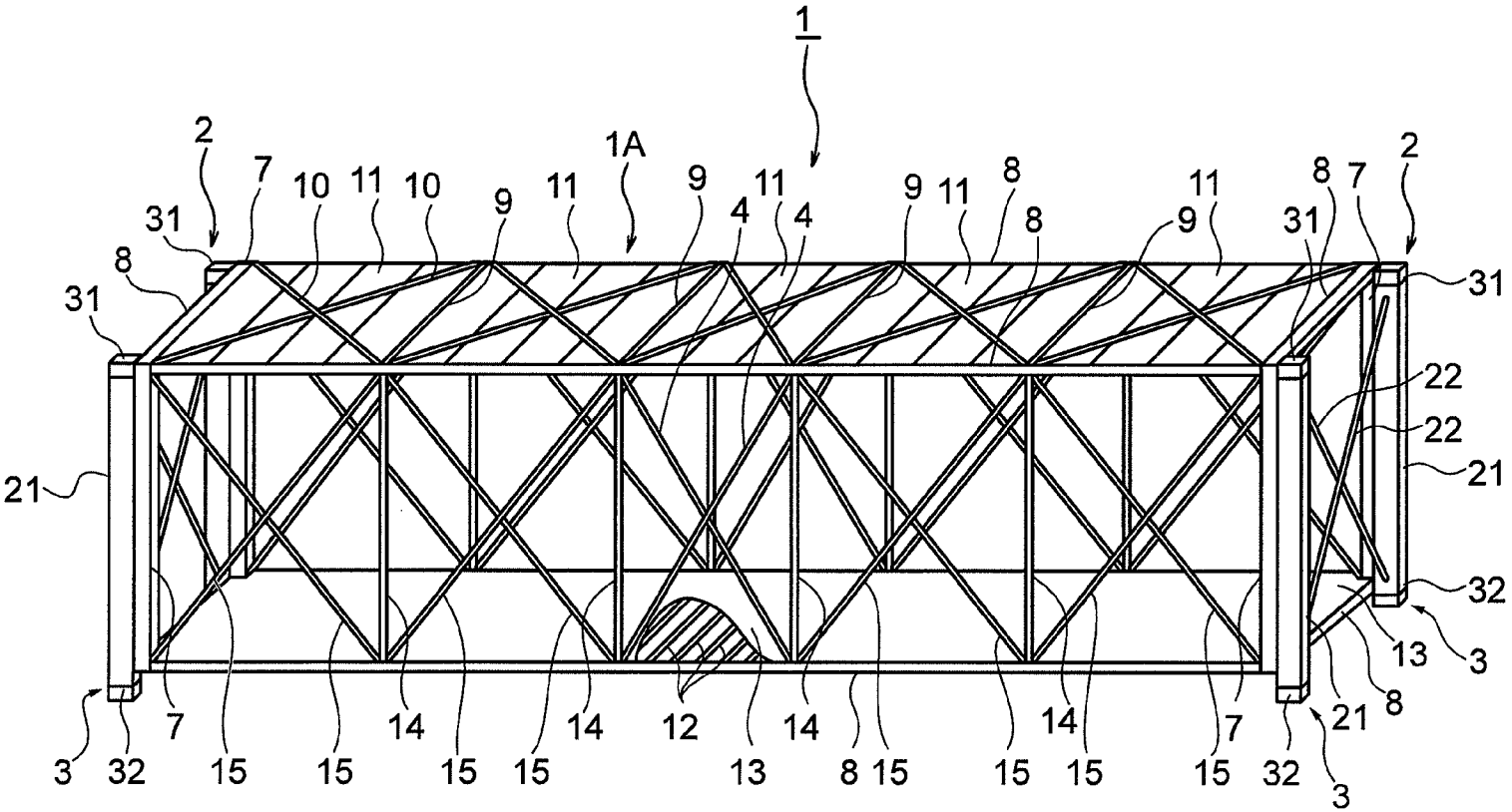
FIG. 1 A perspective view showing a schematic configuration of a building unit with temporary reinforcing members, according to an embodiment of the present invention.

FIG. 1 shows a schematic configuration of a temporary reinforcing member equipped building unit 1 according to an embodiment of the present invention.

First, such a temporary reinforcing member equipped building unit 1 is configured by mainly a long box shape building unit body 1A and temporary reinforcing members 2, 2.

Here, the long box shape building unit body 1A is formed by four steel (H-shaped steel) columns 7 and four steel (H-shaped steel) beams 8, which are rigidly connected at each end portion.

On an upper surface of the building unit body 1A, four reinforcing beams 9 are erected between the beams 8 and horizontal braces 10, 10 are provided in a X-shaped form on each of five structure planes formed by the beams 8 and the reinforcing beams 9. At a lower side of the horizontal braces 10, ceiling panels 11 formed by an ALC (aerated lightweight concrete) plate are applied.

On a lower surface of the building unit body 1A, a plurality of floor joists 12 are erected between the beams 8 and at an upper side of the floor joists, floor panels 13 formed by a particle board are applied.

On long side surfaces (both side surfaces) of the building unit body 1A, four reinforcing columns 14 are erected between the beams 8, 8. Wall braces 14, 14 are provided in an X shaped form on each of four structure planes of the five structure planes formed by the columns 7, 7, the beams 8, 8, and the reinforcing columns 14 except for a center structure plane.

The center structure plane is formed as an opening part of the building unit body 1A and temporary reinforcing braces 4, 4 are detachably provided in an X-shaped form at the opening part by using not illustrated bolts and nuts.

On each of short side surfaces of the building unit body 1A, a temporary reinforcing member 2 formed by erecting braces 22, 22 in an X-shaped form between steel (rectangular steel) reinforcing columns 21, 21 is provided.

In the temporary reinforcing member 2, the reinforcing columns 21, 21 and the columns 7, 7 which are detachable from the reinforcing columns 21, 21 are provided by using a plurality of bolts and nuts (not illustrated).

Figure 2:
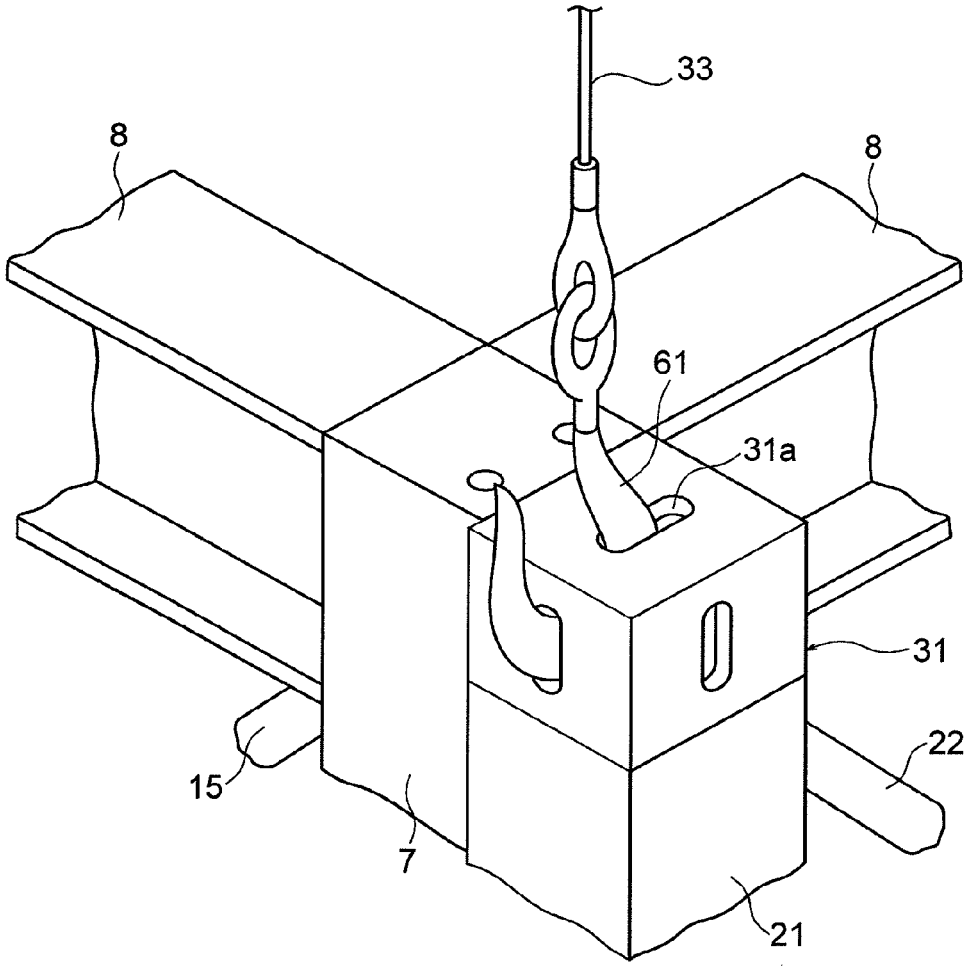
FIG. 2 A partially-enlarged view showing a part vicinity of an upper corner fitting.

On an upper end portion of the reinforcing column 21 as shown in FIG. 2, an upper corner fitting 31, on which a hook hole 31*a* as a hook portion for hoist to hook a hook 61 as an engagement part of a not-illustrated crane is formed, is provided such that an upper end portion of the upper corner fitting 31 is substantially coincided with an upper end portion of the column 7.

Figure 3:
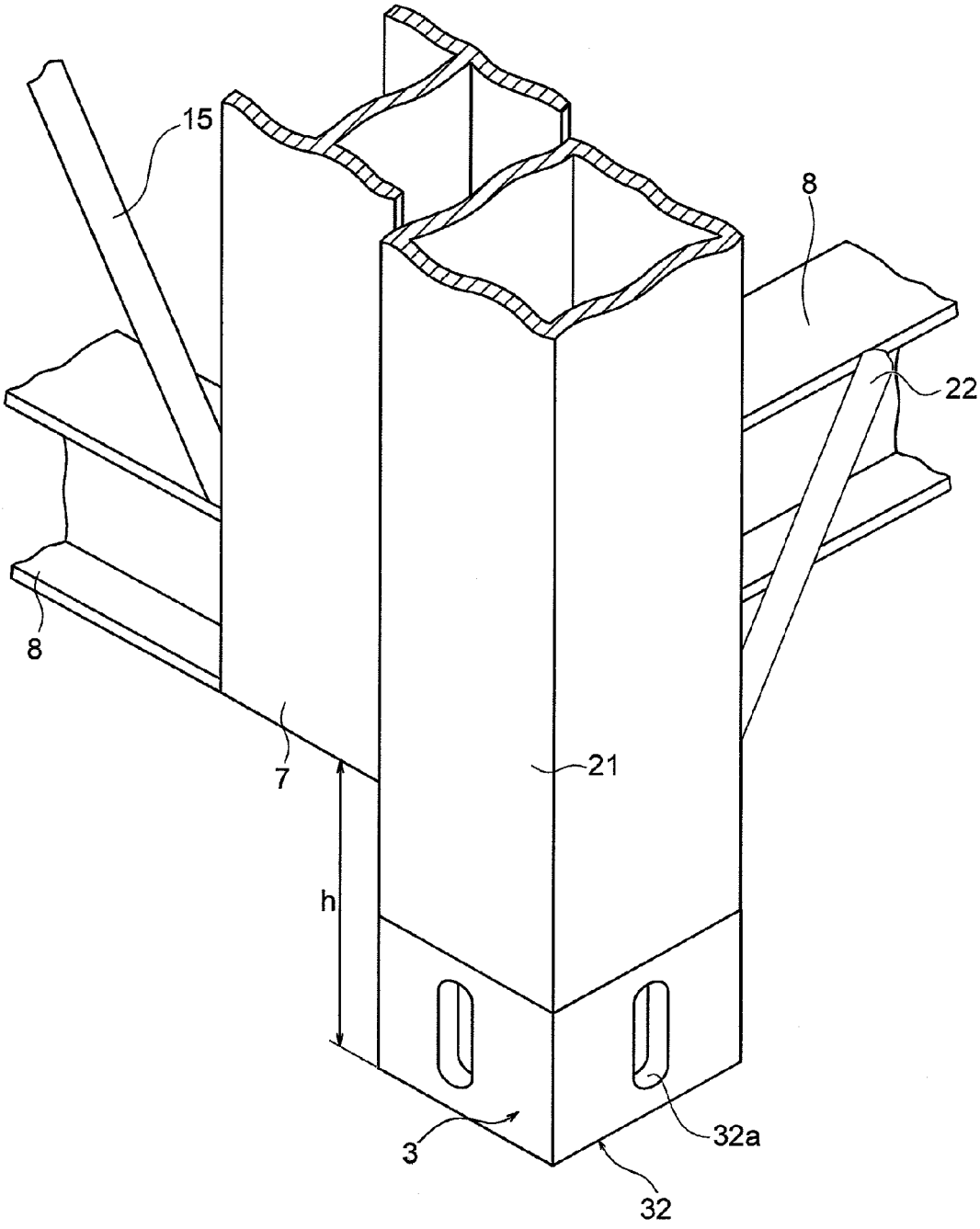
FIG. 3 A partially-enlarged view showing a part vicinity of an lower corner fitting.

On a lower end portion of the reinforcing column 21 as shown in FIG. 3, a lower corner fitting 32 is provided, on which a hook hole 32*a* is formed as a hook portion for transport fixation, which is fixed by a twistlock to an engagement hole provided on a loading platform of a semi-trailer for a container when land transportation or on a floor of an inboard barn when marine transportation.

As a projecting portion 3, the lower end portion of the reinforcing column 21 and the lower corner fitting 32 are projected downwardly from the lower end portion of the building unit body 1A.

A projected height h of the projecting portion 3 is set to be substantially equal to a height (139 mm in a standard of JIS) projecting upwardly from a loading platform of a not-illustrated gooseneck of a semi-trailer for a container as a transport means in accordance with, for example, Road Traffic Act which is a strict Japanese law.

The upper and lower corner fittings 31, 32 are cast as the same.

The engagement part of the not-illustrated crane is not limited to the hook 61 and a shackle or the like may be appropriately used.

Figure 4:
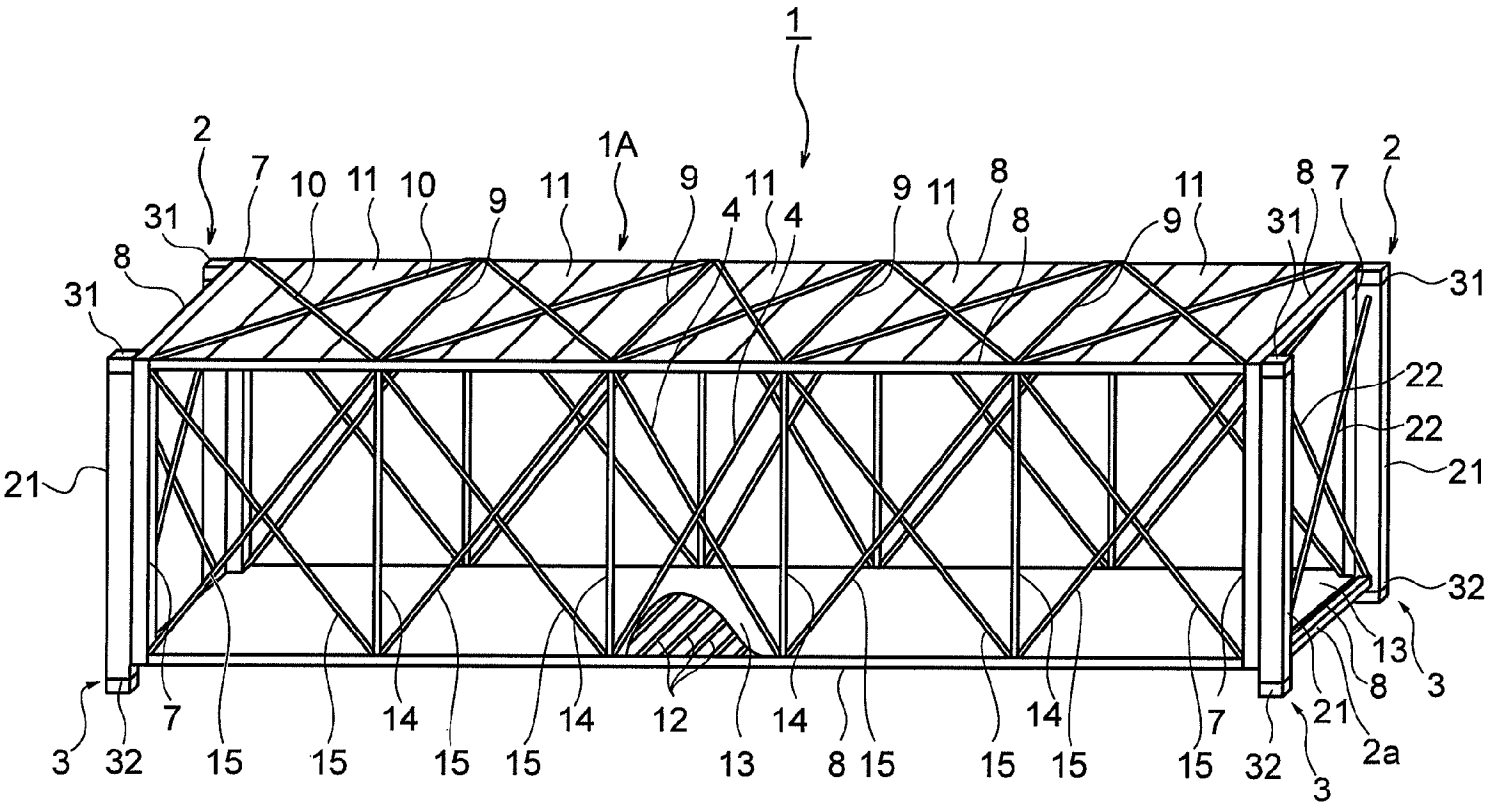
FIG. 4A perspective view showing a schematic configuration of the building unit with the temporary reinforcing members in a case where reinforcing beams are provided on the temporary reinforcing members according to the present invention.

As shown in FIG. 4, a reinforcing beam 2*a* may be erected at a height position slightly lower than the bottom surface of the building unit body 1A between the reinforcing columns 21, 21 of the temporary reinforcing member 2.

In this case, when the temporary reinforcing member equipped building unit 1 is loaded on the semi-trailer for a container for the land transportation, since the building unit body is protected by the reinforcing beam 2*a*, the bottom surface of the building unit body 1A is prevented from being damaged by contacting with the gooseneck.

The temporary reinforcing member equipped building unit 1 is supported on the gooseneck through the reinforcing beam 2*a* at a front gooseneck side of the loading platform of the semi-trailer for a container. Accordingly, it is prevented that the beam 8 at a lower side of the short side surface is damaged and that a coating of the beam is removed.

Next, a method for constructing a unit building according to an embodiment of the present invention will be explained.

Figure 5:
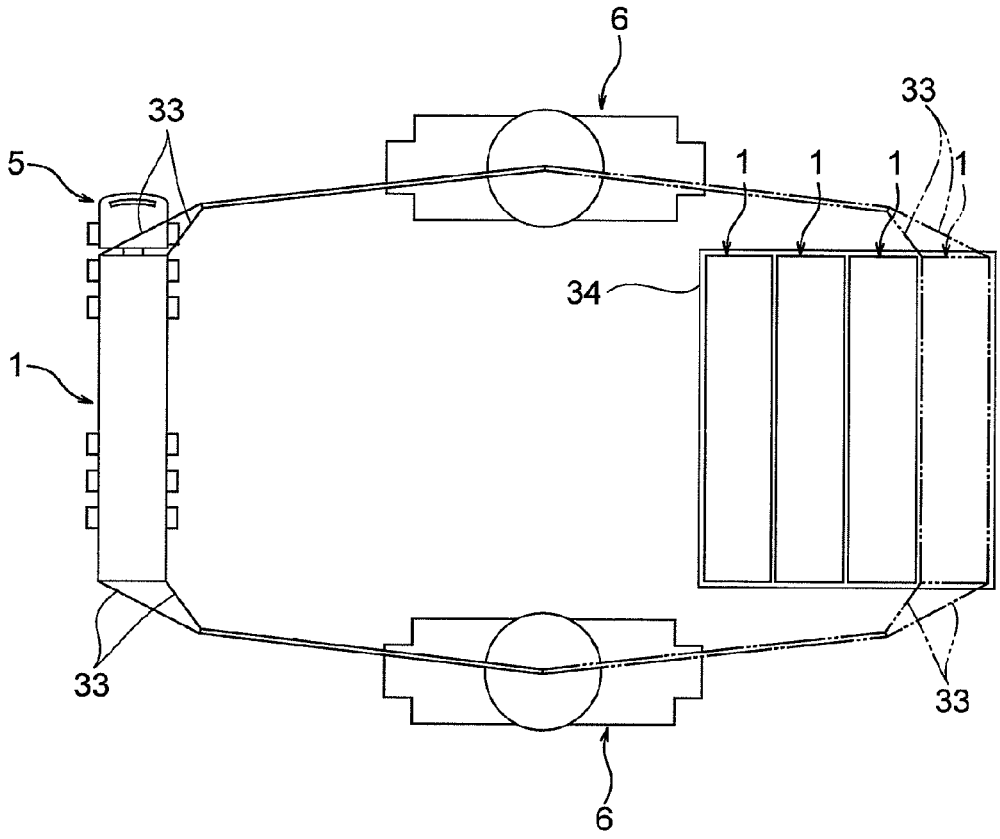
FIG. 5 An explanation view showing a construction stage of a method for constructing a unit building according to the embodiment.

The method for constructing the unit building according to an embodiment of the present invention is, as shown in FIG. 5, two cranes 6, 6 are disposed at sides of both short side surfaces of the temporary reinforcing member equipped building unit 1 according to the above described embodiment of the present invention transported by a semi-trailer 5 for a container as the transporting means in accordance with, for example, the Road Traffic Act which is the strict Japanese law.

Figure 6:
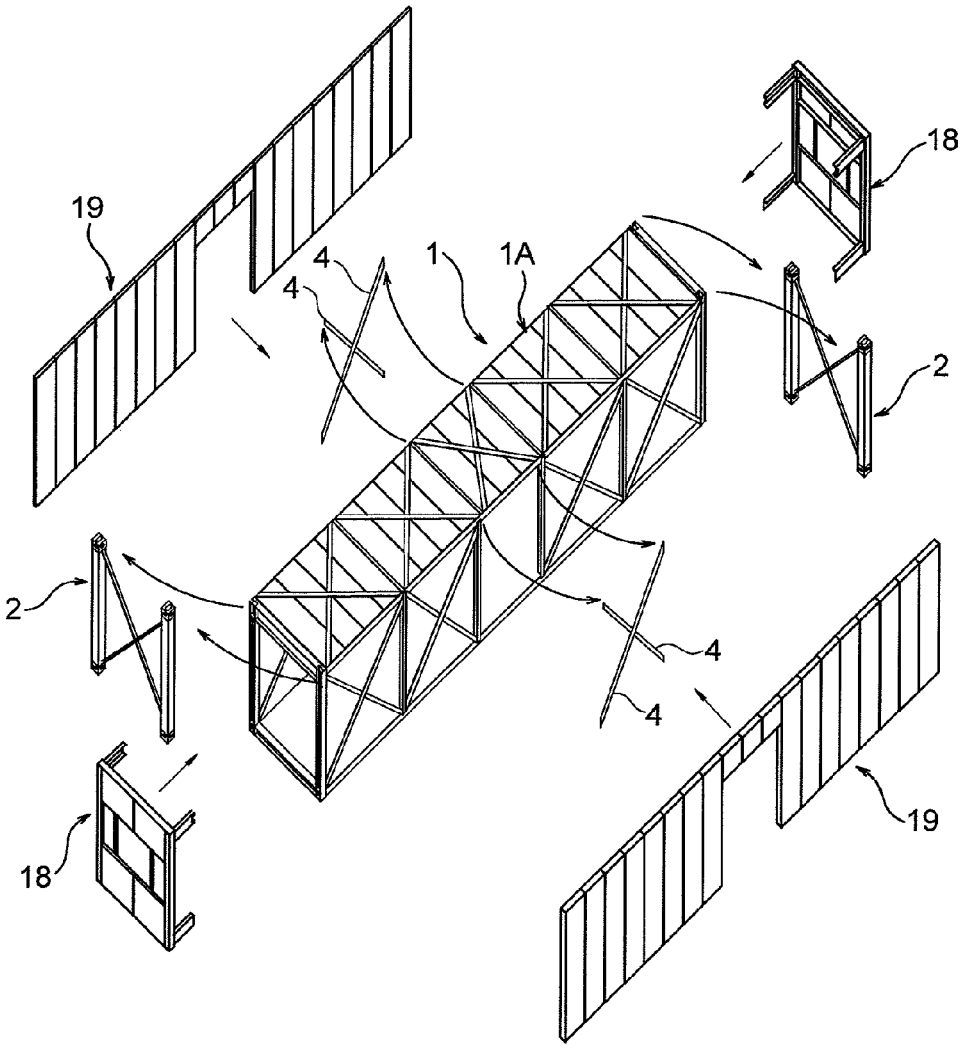
FIG. 6 An explanation view showing a construction stage of the method for constructing the unit building according to the embodiment.

More specifically, as shown in FIG. 2, for both of the two cranes, the hooks 61, 61 provided at ends of two wires 33, 33 are, as shown in FIG. 6, hooked in not-illustrated temporary hook portions provided on four corners at an upper side of the building unit body 1A, respectively, after removing the temporary reinforcing members 2, 2 and the temporary reinforcing braces 4.

Then, the building unit body 1A is hoisted while maintaining a balance, moved to a position, where a groundwork of a building site is provided, arranged, built-up, and assembled.

The temporary reinforcing members 2, 2 may remain and hook holes 31*a* of the upper corner fittings 31 may be used to transfer the temporary reinforcing member equipped building unit 1 and then the temporary reinforcing members 2, 2 and the temporary reinforcing braces 4 may be removed from the temporary reinforcing member equipped building unit 1.

For the transferred building unit body 1A as described above, on both short side surfaces of the building unit body 1A with the temporary reinforcing members 2, 2 removed, outer wall steel plate panels 18 as overhang members each having a narrower width than the short side surface are attached.

The wall steel plate panel 18 may be attached by not-illustrated bolt and nut by use of a bolt hole by which the temporary reinforcing member 2 is attached.

On the long side surfaces (both side surfaces) of the building unit body 1A, fireproof boundary wall panels 19 each formed by an ALC plate are attached, respectively.

Figure 7:
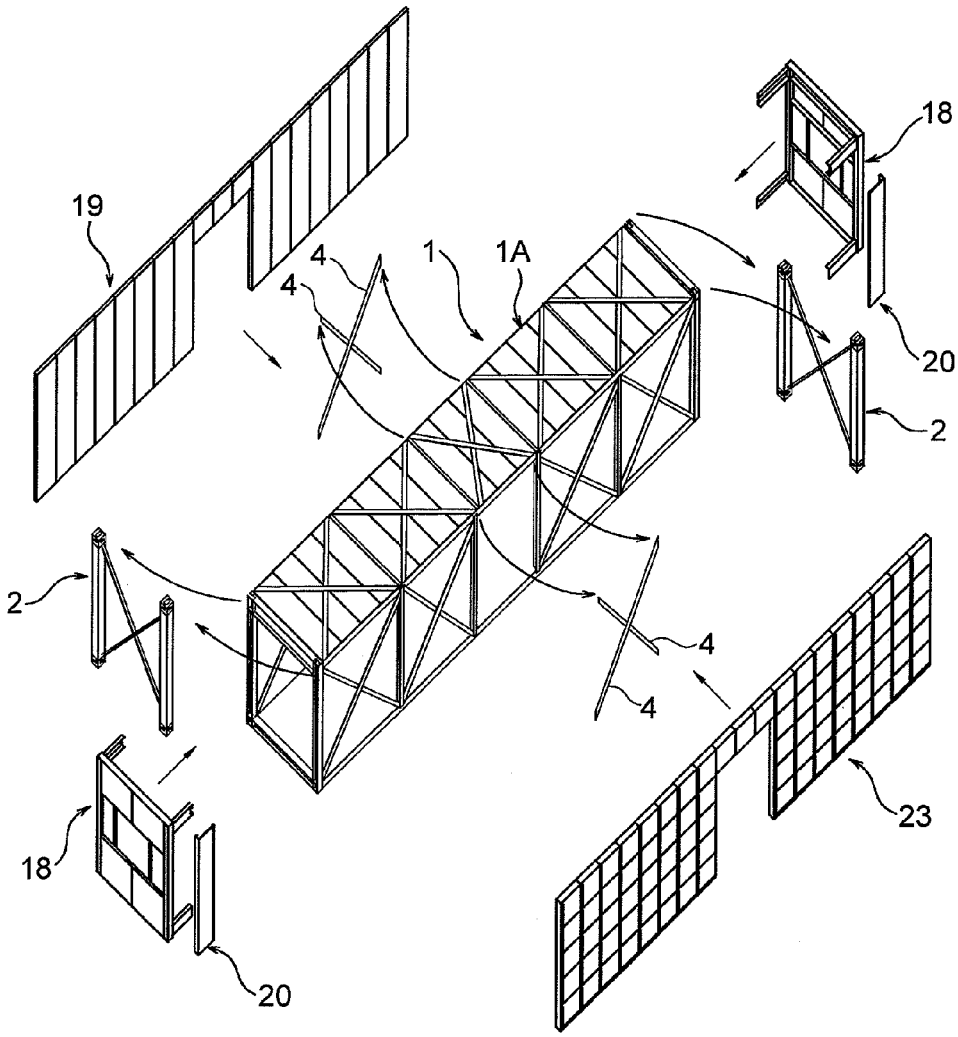
FIG. 7 An explanation view showing a construction stage of the method for constructing the unit building according to the embodiment.

On the outer long side surface (side surface) of the building unit body 1A, which faces outside, as shown in FIG. 7, instead of the fireproof boundary wall panel 19, an outer wall panel 23 formed by an ALC plate is attached and corner outer wall panels 20, 20 are attached to corner portions.

The fireproof boundary wall panel 19 and the outer wall panel 23 may be preliminarily attached to the building unit body 1A.

Then, for the temporary reinforcing member equipped building unit 1 transported by the following semi-trailer 5 for a container, operations similarly to the above operations are performed.

During this time, a curtain wall unit 35A as a decorative member is attached between the corner outer wall panel 20 and the outer steel plate panel 18 to fill a gap therebetween and a curtain wall unit 35B as a decorative member having a width about two times of the curtain wall unit 35A is attached between the outer wall steel plate panels 18, 18 to fill a gap therebetween.

Figure 8:
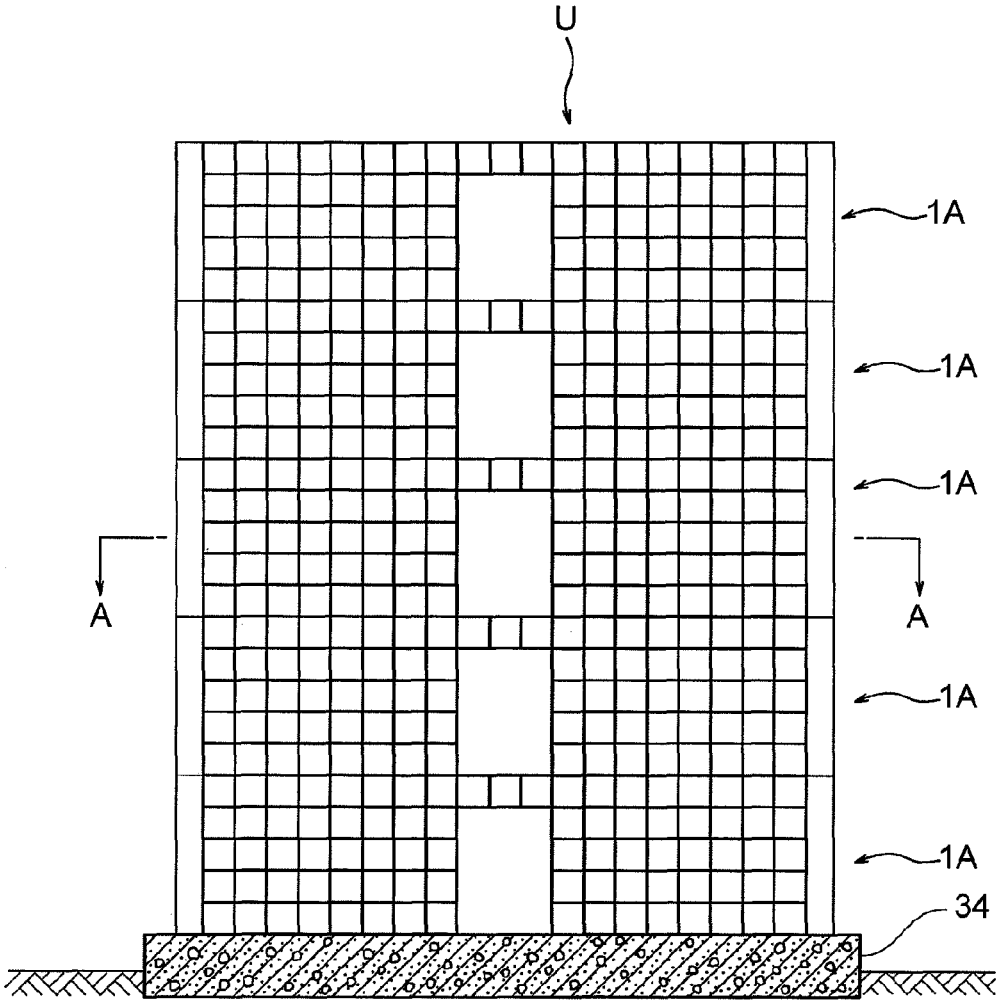
FIG. 8 A front view showing a schematic configuration of the unit building according to the embodiment.
Figure 9:
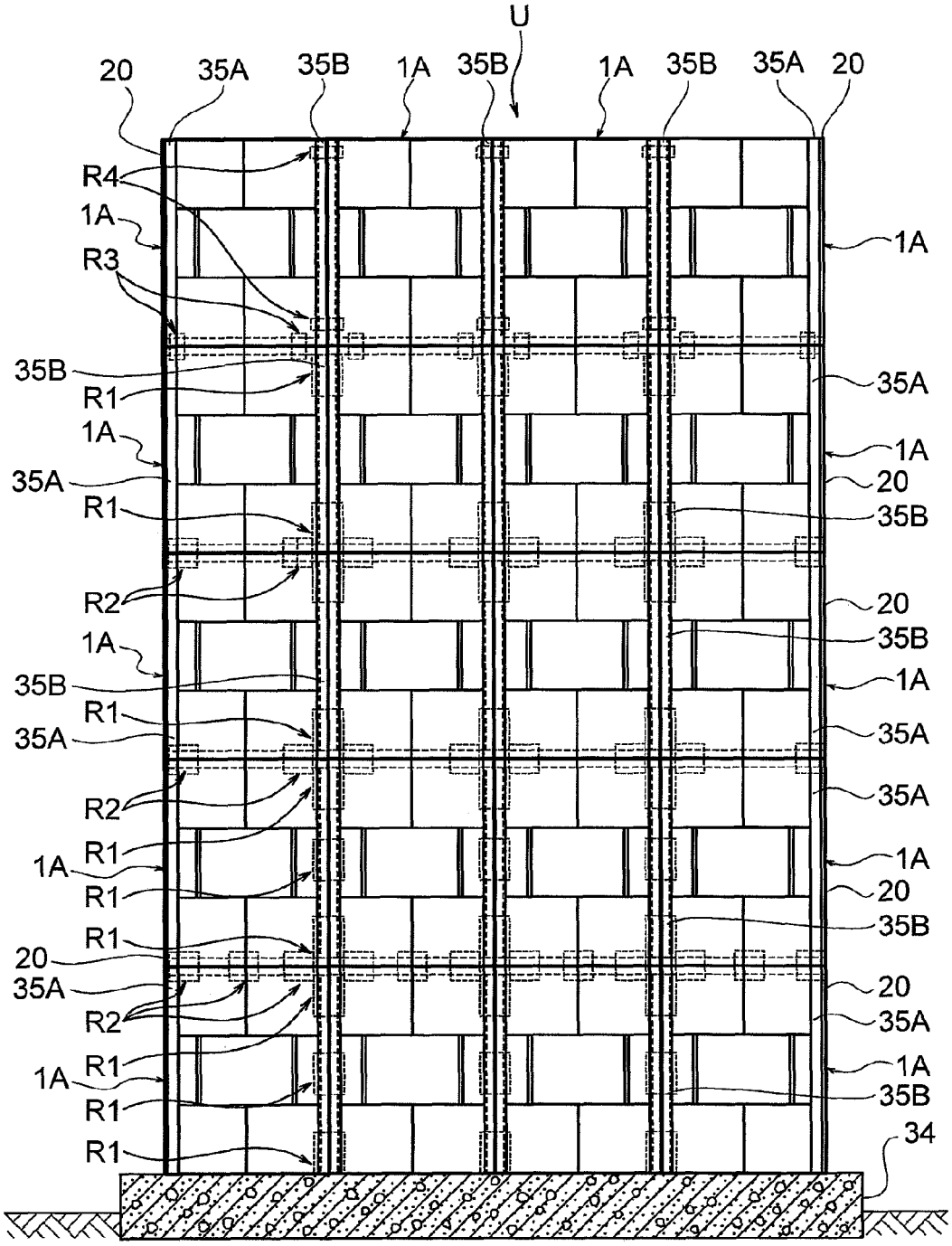
FIG. 9 A side view of FIG. 8.

As described above, as shown in FIGS. 8 and 9, in the embodiment of the present invention, horizontally arranged four building unit bodies 1A and vertically arranged five building unit bodies 1A, that is, twenty building unit bodies 1A in total are assembled to construct a unit building U.

In the unit building U according to the embodiment, constructed as described above, as shown in FIG. 9, the columns 7, 7 of the building unit bodies 1A for a first floor are rigidly connected by composite connections R1 at the upper and lower end portions and intermediate portions therebetween.

Figure 10:
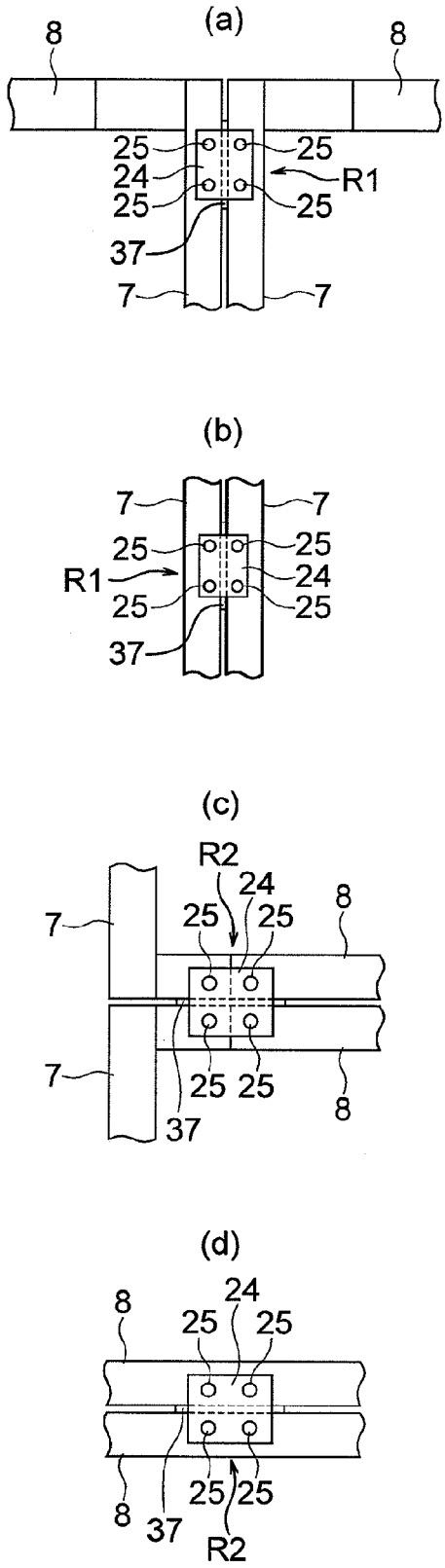
FIG. 10 Explanatory views (a) to (d) showing composite-connected parts between the building unit bodies.

In the composite connection R1, as shown in FIGS. 10A and 10B, flanges of the H-shaped steel columns 7, 7 are combined in a rigid manner by a steel plate 24 with a plurality of bolts 25 (here, four bolts) and nuts (not illustrated) via a spacer 37.

The beams 8, 8 of the building unit bodies 1A for a second floor are rigidly connected with the beams 8, 8 of the building unit bodies 1A for the first floor by composite connections R2 at left and right ends and intermediate portions therebetween, respectively.

In the composite connection R2, as shown in FIGS. 10C and 10D, flanges of the H-shaped steel beams 8, 8 are combined in a rigid manner by the steel plate 24 with a plurality of bolts 25 (here, four bolts) and nuts (not illustrated) via the spacer 37.

The columns 7, 7 of the building unit bodies 1A for the second floor are rigidly connected by the composite connections R1 at the upper and lower end portions and intermediate portions therebetween, respectively.

The beams 8, 8 of the building unit bodies 1A for a third floor are rigidly connected with the beams 8, 8 of the building unit bodies 1A for the second floor by the composite connections R2 at left and right ends, respectively.

The columns 7, 7 of the building unit bodies 1A for the third floor are rigidly connected by the composite connections R1 at the upper and lower end portions, respectively.

The beams 8, 8 of the building unit bodies 1A for a fourth floor are rigidly connected with the beams 8, 8 of the building unit bodies 1A for the third floor by the composite connections R2 at left and right ends, respectively.

The columns 7, 7 of the building unit bodies 1A for the fourth floor are rigidly connected by the composite connections R1 at the upper and lower end portions, respectively.

The beams 8, 8 of the building unit bodies 1A for a fifth floor are connected with the beams 8, 8 of the building unit bodies 1A for the fourth floor by pin connections R3 at left and right ends, respectively.

Figure 11:
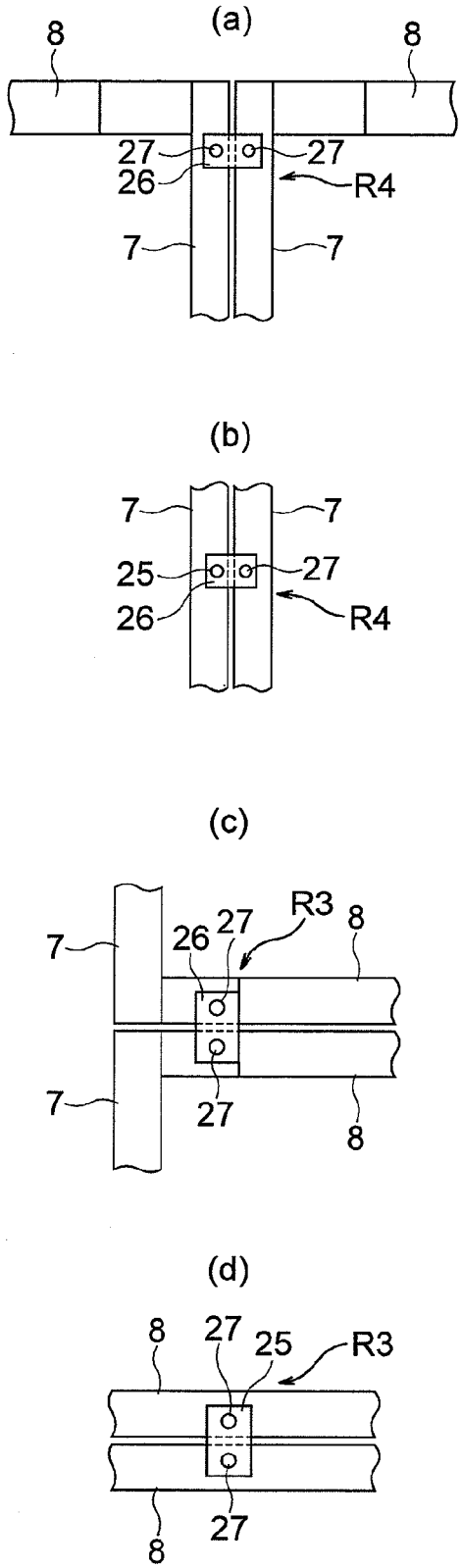
FIG. 11 Explanatory views (a) to (d) showing pin-connected parts between the building unit bodies.

In the pin connection R3, as shown in FIGS. 11C and 11D, flanges of the H-shaped steel beams 8, 8 are merely connected by a steel plate 26 with two bolts 27, 27 and not-illustrated nuts.

The columns 7, 7 of the building unit bodies 1A for the fifth floor are connected by pin connections R4 at the upper and lower end portions, respectively.

In the pin connection R4, as shown in FIGS. 11A and 11B, flanges of the H-shaped steel columns 7, 7 are merely connected by the steel plate 26 with the two bolts 27, 27 and the not-illustrated nuts.

As described above, the unit building body 1 are assembled such that connection strength is increased as a floor level is decreased to achieve required strength of the unit building U.

Figure 12:
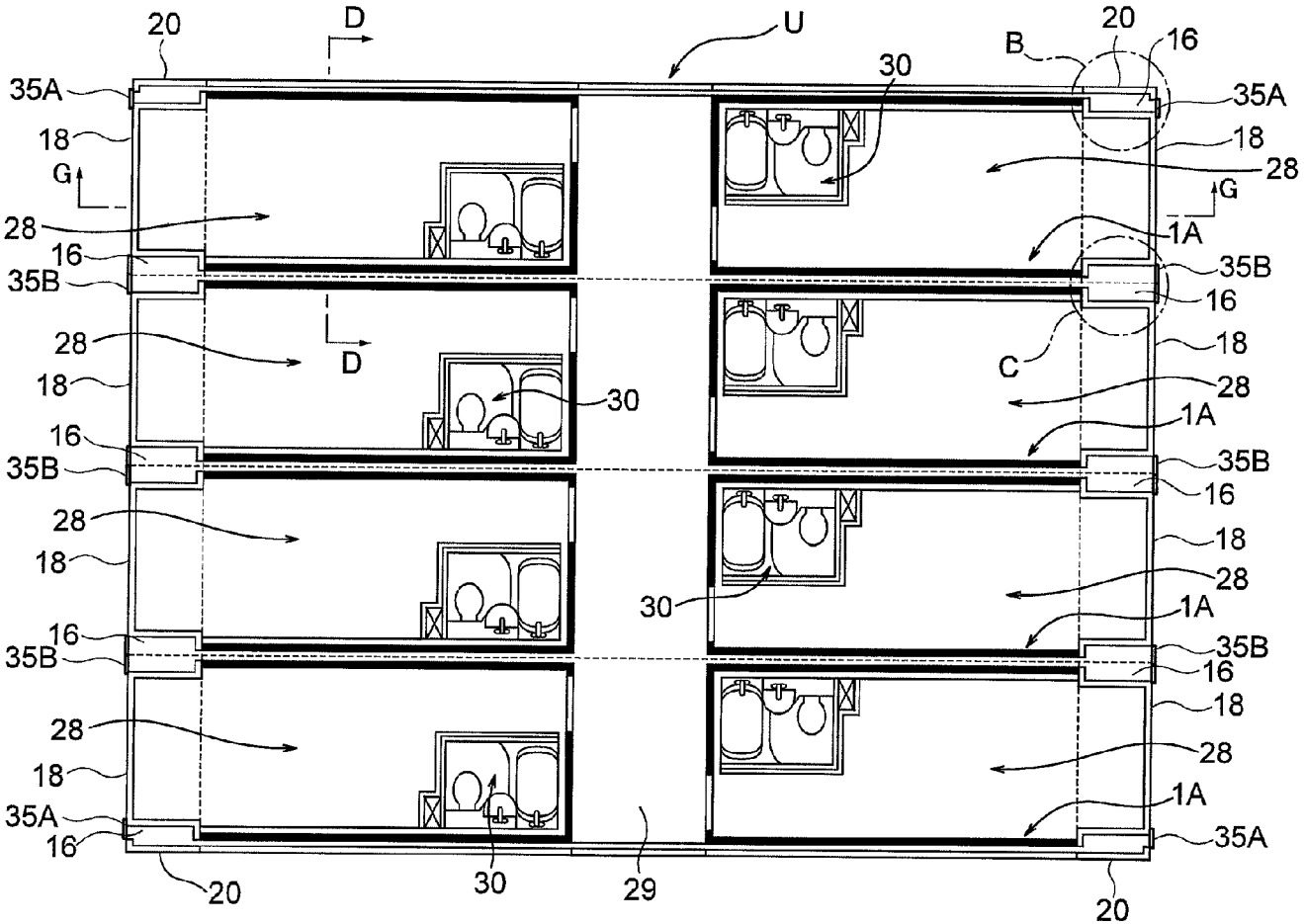
FIG. 12 A section view on arrow of an A-A line of FIG. 8.

Inside the unit building U, as shown in FIG. 12, there are four rooms 28 at both sides of a central passage 29 formed by communicating the openings of the building unit bodies 1A that is, eight rooms in total for one floor.

In each room 28, a water equipment room 30 including a wash stand, a toilet, and a bathroom is provided at a side after an entrance.

In each room 28, a large region inside a part indicated by a dot line, where the water equipment room 30 is provided, is formed on the building unit body 1A and a small region outside the part indicated by the dot line at a window side is formed on the outer steel plate panel 18 as the overhang member.

Figure 14:
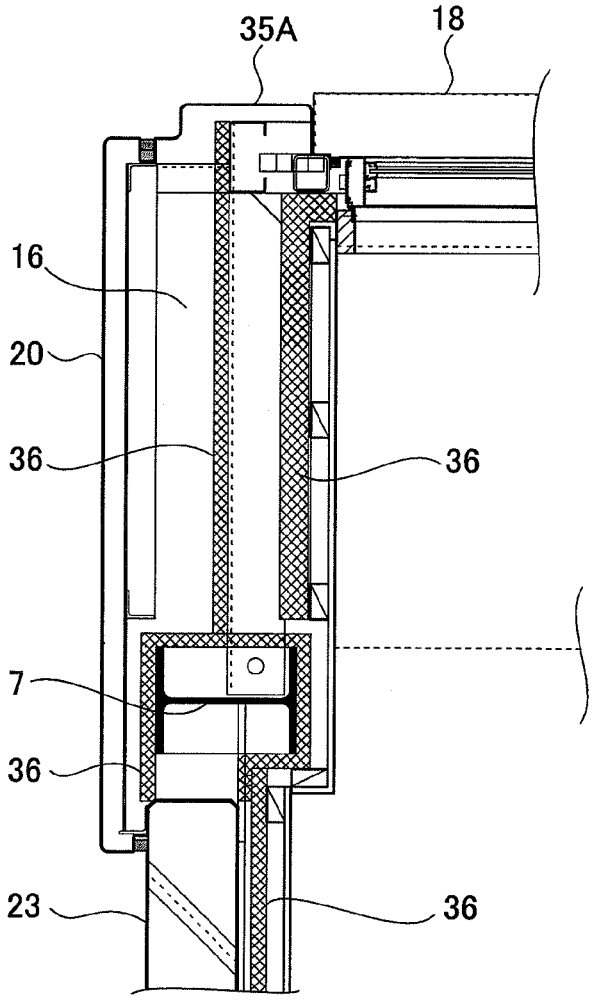
FIG. 14 A partially enlarged view in a B part of FIG. 12.
Figure 15:
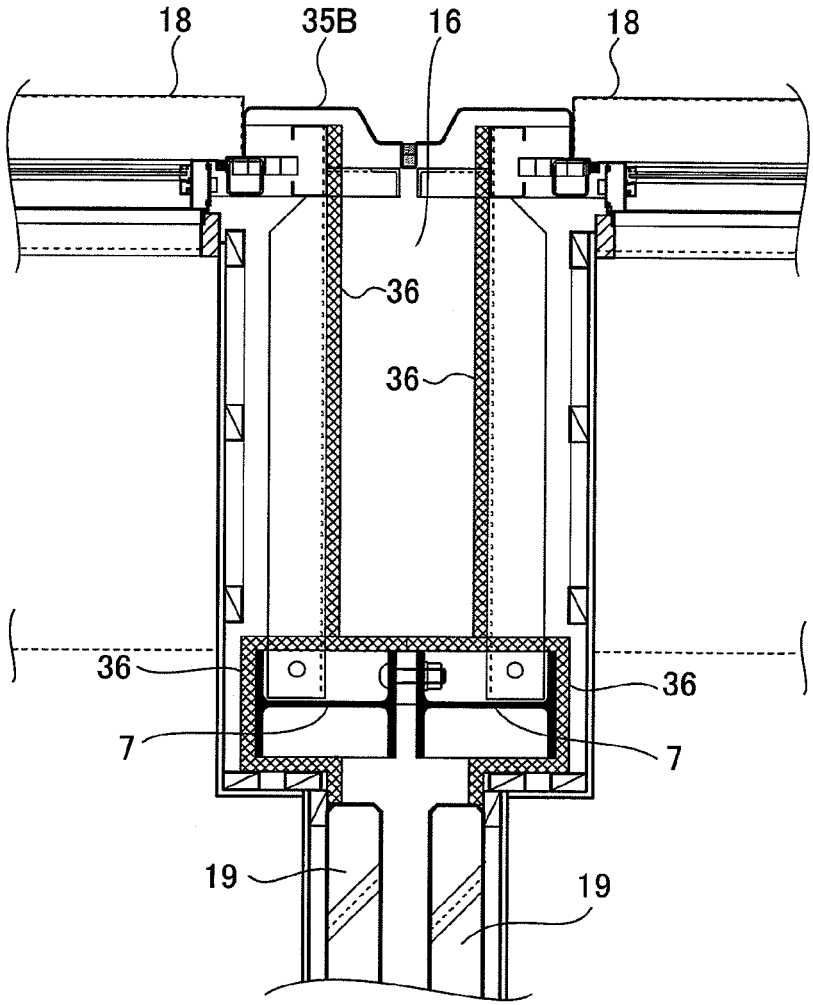
FIG. 15 A partially enlarged view in a C part of FIG. 12.

Not illustrated pipes from the water equipment room 30 are, as shown in FIG. 14 and FIG. 15, arranged at a vacant space 16 of the short side surface of the building unit body 1A.

The vacant spaces 16 are formed, at a corner portion of the unit building U, so as to communicate from first to fifth floors inside the corner outer wall panel 20 and the curtain wall unit 35A and at a center portion, so as to communicate from first to fifth floors inside the curtain wall unit 35B.

Here, the vacant spaces 16 may be used for air conditioning in addition to the pipes.

Figure 13:
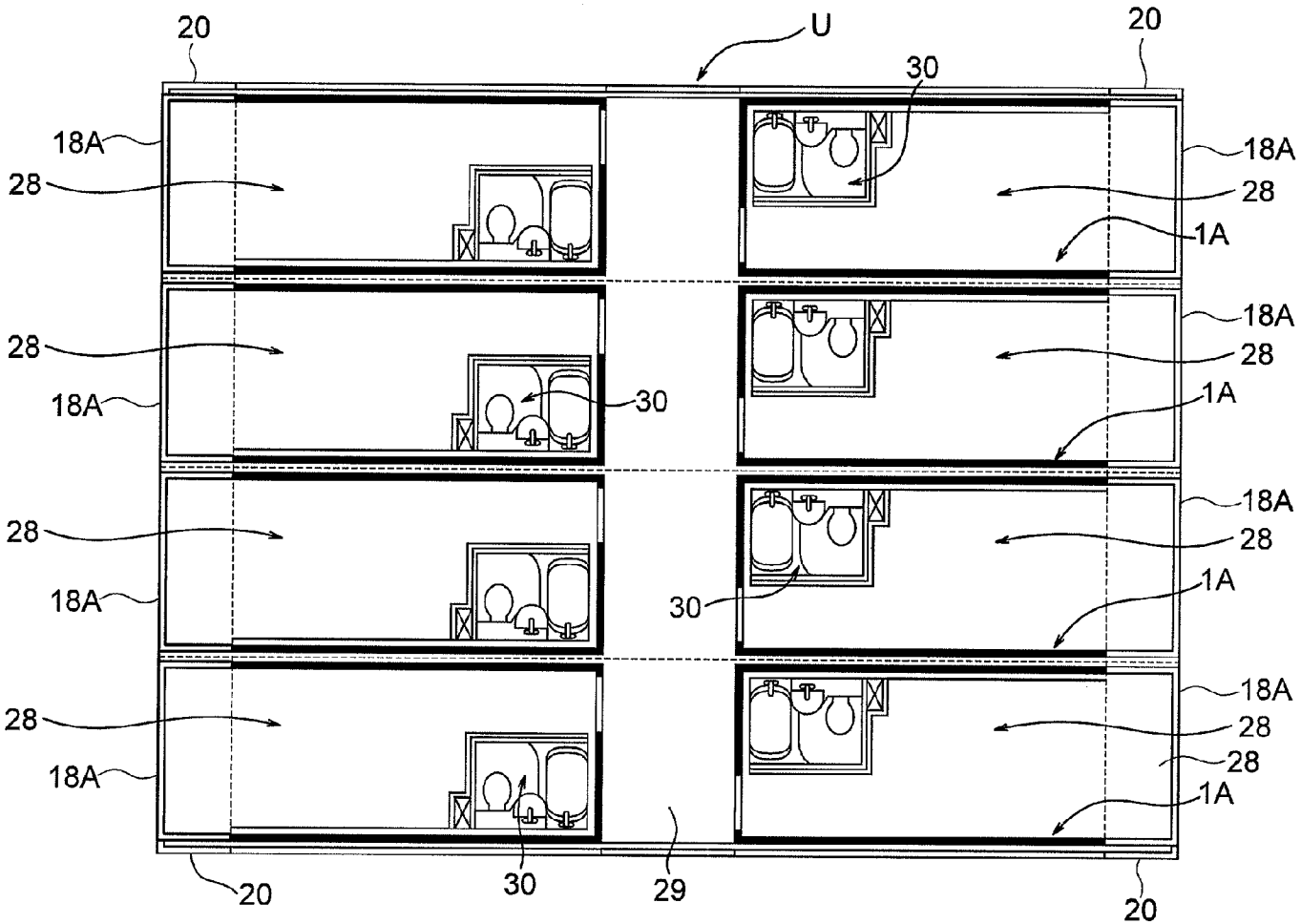
FIG. 13 A horizontal section view showing a schematic configuration of an inside of a unit building in a case where a cantilever supported balcony is formed.

In the unit building U, as shown in FIG. 13, a balcony member 18A as an overhang member may be attached to the short side surface of each building unit body 1A to form a cantilever supported balcony by the continuous balcony members 18A.

Although it is not illustrated, as the overhang member, a cantilever supported passage may be formed by attaching a passage member instead of the balcony member 18A.

In these cases, the cantilever supported balcony or the cantilever supported passage can be provided with a simple operation.

Here, at the corner portion of the unit building U, as shown in FIG. 14, fireproof covering materials 36, . . . such as rock wools cover between the outer wall panel 23 formed by an ALC plate and the outer wall steel plate panel 18 to provide fireproof and heat insulation properties.

At the center portion of the unit building U, as shown in FIG. 15, fireproof covering materials 36 such as rock wools cover between the fireproof boundary wall panel 19 formed by the ALC plate and the outer wall steel plate panel 36 to provide fireproof and heat insulation properties.

Figure 16:
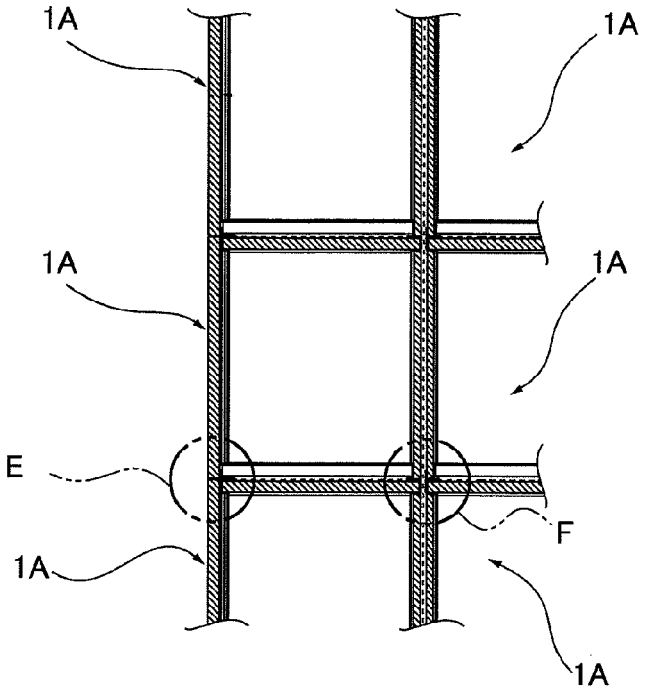
FIG. 16 A section view on arrow of a D-D line of FIG. 12.
Figure 17:
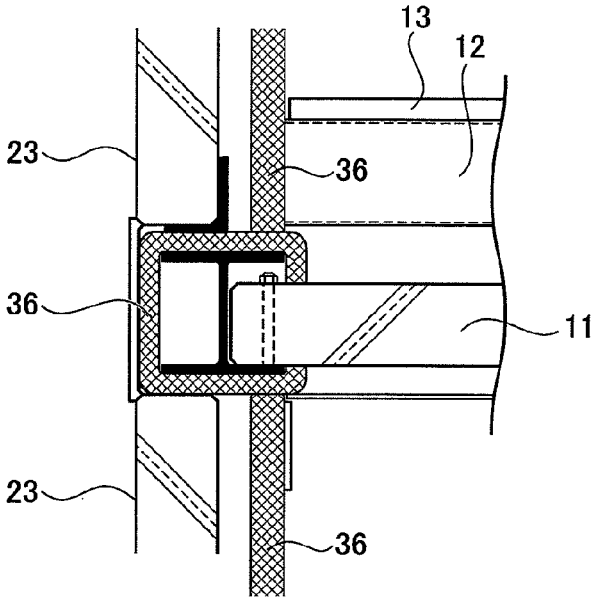
FIG. 17 A partially enlarged view in an E part of FIG. 16.
Figure 18:
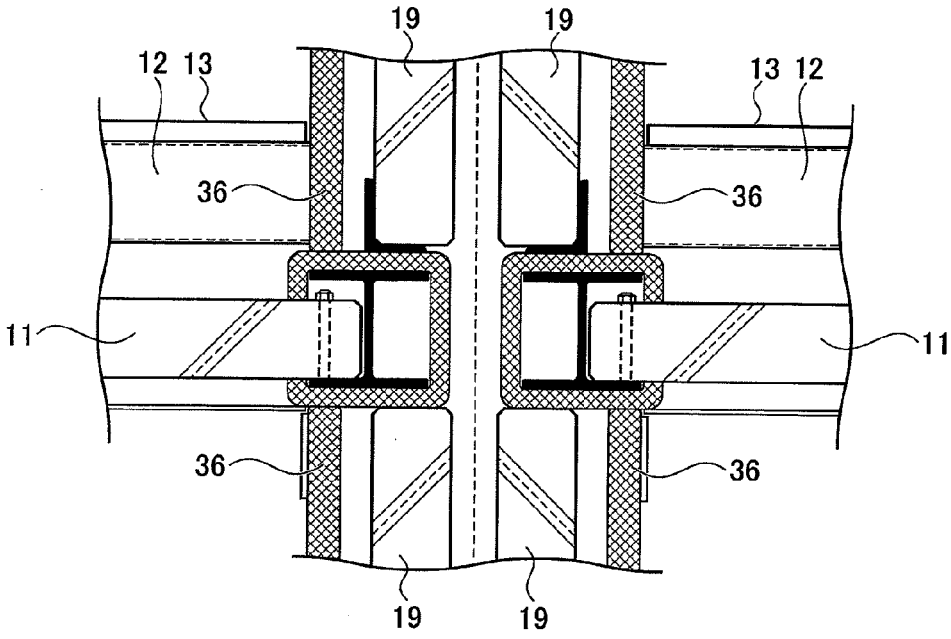
FIG. 18 A partially enlarged view in an F part of FIG. 16.

As shown in FIGS. 16 to 18, fireproof covering materials 36 such as rock wools cover between the outer wall panels 23, 23 formed by the ALC plates and the ceiling panel 11 formed by the ALC plate and between the fireproof boundary wall panel 19 formed by the ALC plate and the ceiling panel 11 formed by the ALC plate to provide fireproof and heat insulation properties.

Figure 19:
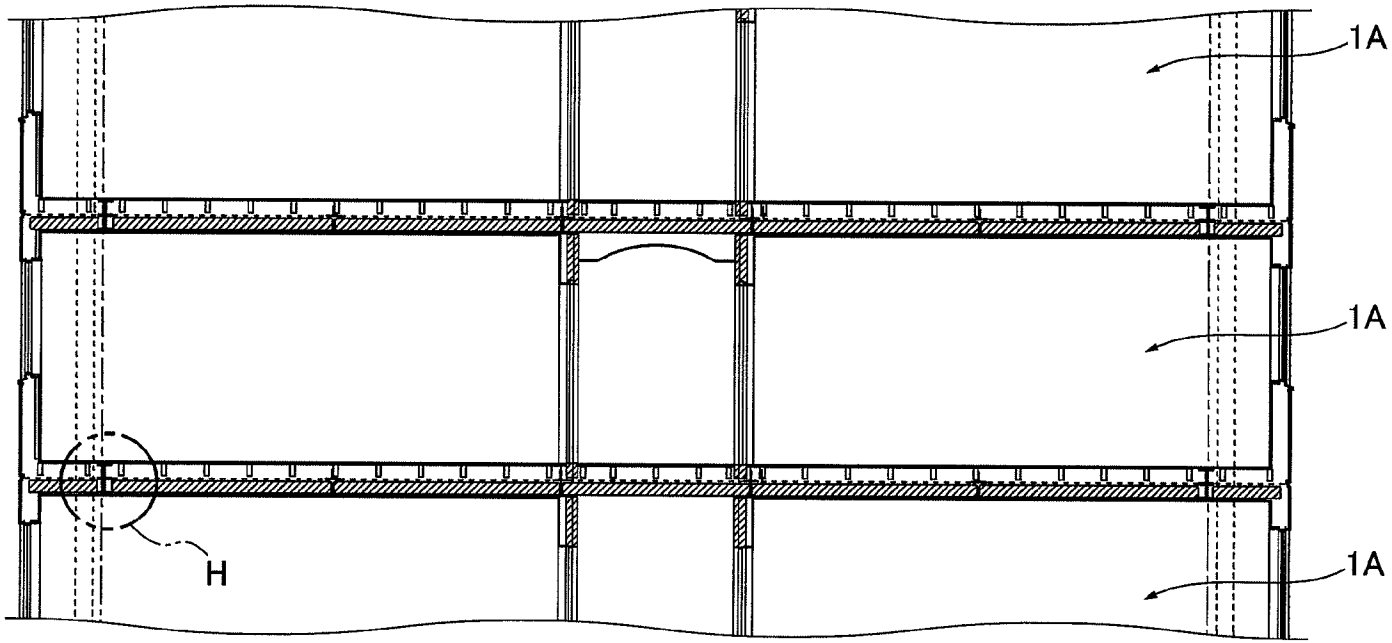
FIG. 19 A section view on arrow of a G-G line of FIG. 12.
Figure 20:
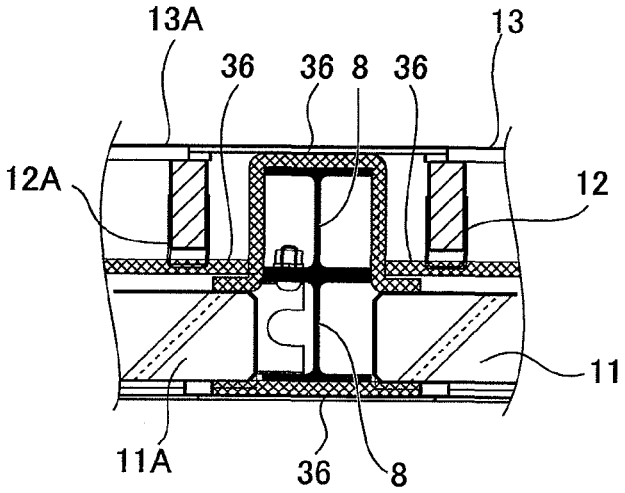
FIG. 20 A partially enlarged view in an H part of FIG. 19.

As shown in FIGS. 19 and 20, fireproof covering materials 36 such as rock wools cover between the ceiling panel 11A of the outer wall steel plate panel 18 as the later-attached overhang member, which is formed by the ALC plate, and the ceiling panel 11 formed by the ALC plate.

Although the floor joists 12A and the floor panel 13A formed by a particle board constituting a floor structure of the outer wall steel plate panel 18 are later-attached, the floor joists 12A and the floor panel 13A may be preliminarily attached.

Next, function effects of the present invention will be explained.

The temporary reinforcing member equipped building unit 1 according to such an embodiment has a configuration in which the detachable temporary reinforcing member 2 is provided on each of the short side surfaces of the building unit body 1A and in the temporary reinforcing member 2, at the lower end portion thereof, the lower end portion of the reinforcing column 21 and the lower corner fittings 32 downwardly project as the projecting portions 3 with the same length.

Due to such a configuration, if the temporary reinforcing member equipped building unit 1 has a length over a length from a rear end part of the loading platform to a rear end part of the gooseneck of the semi-trailer 5 for a container as the transport means in accordance with, for example, Road Traffic Act which is a strict Japanese law. Accordingly, the temporary reinforcing member equipped building unit 1 is supported at a gooseneck side, that is, a front side of the loading platform of the semi-trailer for a container, on the gooseneck by the beam disposed on the lower side of the short side surface, and supported, at a rear side, on the loading platform by the projecting portions 3, 3 so that the temporary reinforcing member equipped building unit 1 is substantially horizontally supported. Therefore, it is not necessary to provide a notch or the like, which degrades structural durability, on the lower surface of the building unit body 1A so that the building unit 1 can be stably loaded on the loading platform of the semi-trailer for a container.

Accordingly, when the unit building U especially having a medium-scale or more such as an apartment house is constructed, it is possible to provide the long and large size building unit capable of increasing construction efficiency and reducing a construction period.

In the transport process, when transporting by sea, in an inboard barn, load of a plurality of loaded temporary reinforcing member equipped building units 1 each having same size is borne by the rigid and strong temporary reinforcing members 2 so that it is not required to increase thickness of the columns 7 of the building unit 1A and it is economically achieved.

In the temporary reinforcing member equipped building units 1 in the inboard barn, the building unit body 1A is not damaged because the temporary reinforcing members 2, 2 are disposed outside the building unit body 1A to guard the building units 1. Accordingly, transport can be performed while maintaining high quality.

The temporary reinforcing member 2, 2 are detachable and therefore useful for many occasions and economical.

Since the temporary reinforcing member 2 has the hook holes 31*a*, 31*a* as a hook portion for hoist, the building unit body 1A may be hoisted by hooking hooks 61, 61 of the crane 6 in the hook holes 31*a*, 31*a* so that the building unit body is not damaged.

The temporary reinforcing member 2 has the hook holes 32*a*, 32*a* as a hook portion for transport fixation.

Thereby, when the temporary reinforcing member equipped building unit 1 is land-transported by the semi-trailer for a container, by fixing the hook holes 32*a* for transport fixation to the engagement holes provided on the loading platform through the twistlock, the building unit body 1A can be land-transported in a stable state without being damaged.

When the temporary reinforcing member equipped building units 1, . . . each having the same size are loaded up in the inboard barn and transported by sea, a lowermost part of the temporary reinforcing member equipped building units are fixed by hooking the hook holes 32*a*, . . . for transport fixation in the engagement holes provided on the floor of the inboard barn through the twistlock. Parts loaded on the lowermost part of the temporary reinforcing member equipped building units 1 are fixed by hooking the transport fixation hook holes 32*a*, . . . in the hoist hook holes 31*a*, . . . of the lower temporary reinforcing member equipped building unit through the twistlock. Accordingly, the building unit body 1A can be transported by sea in a stable state without being damaged.

The temporary reinforcing member 2 is configured such that the braces 22, 22 are erected between the reinforcing columns 21, 21 disposed on both of left and right ends of the short side surface of the building unit body 1A. Accordingly, since the temporary reinforcing member 2 has a simple structure in which the reinforcing columns 21, 21 bear a vertical load and the braces 22, 22 bear a horizontal load, this can be performed with low cost.

On the upper end portion of the reinforcing column 21, the upper corner fitting 31 is provided and the hook hole 31*a* as the hook portion for hoist is formed on the upper corner fitting 31. Accordingly, the temporary reinforcing member equipped building unit 1 can be hoisted with a good balance without damaging the building unit body 1A.

Since on the lower corner fitting 32 provided on the lower end portion of the reinforcing column 21, the hook hole 32*a* as the hook portion for transport fixation is formed, the temporary reinforcing member equipped building unit 1 can be transported in a stable state without damaging the building unit body 1A.

Since the detachable temporary reinforcing braces 4 are provided at the opening part of the long side surface (side surface) of the building unit body 1A, the opening part of the long side surface of the building unit body 1A and the vicinity thereof, which have strength lesser than the other parts, are reinforced. Accordingly, excess deformation can be suppressed to maintain quality of the building unit body 1A to be high.

The unit building U according to this embodiment, using the temporary reinforcing member equipped building units 1 according to the embodiment has a configuration in that a plurality of building unit bodies 1A with the temporary reinforcing members 2, 2 removed are assembled. Accordingly, they are not required to be designed with excessively high strength as required for transportation by sea and therefore may be designed with strength required for the unit building U.

Here, four building unit bodies 1A are horizontally arranged and five building unit bodies 1A are vertically loaded up, and these building unit bodies 1A are assembled such that connection strength increases as the floor level decreases by combining the composite connections R1, R2 to combine between the columns 7, 7 and between beams 8, 8 in a rigid state and the pin connections R3, R4 to merely connect therebetween at the short side surfaces.

Therefore, required strength for the unit building U can be provided while reducing constructing processes.

At the short side surfaces of the building unit bodies 1A the outer wall steel plate panels 18 as the overhang members having a width narrower than the short side surface are attached respectively. At the corner parts of the building unit bodies 1A each directed outwardly, the corner outer wall panels 20 are also attached.

Then, the curtain wall unit 35A as the decorative member is attached between the outer wall steel plate panel 18 and the corner outer wall panel 20, the curtain wall unit 35B as the decorative member is attached between the outer wall steel plate panels 18, 18, and vacant spaces 16 are formed inside the curtain wall units 35A and 35B respectively.

Therefore, these vacant spaces 16 may be effectively used for a pipe and an air conditioner.

On the long side surfaces (side and ceiling surfaces) of the building unit bodies 1A the outer wall panel 23 and the fireproof boundary wall panel 19 which are formed by the ALC plates as well as the ceiling panel 11 are provided, and on the ceiling surfaces, the ceiling panels 11A formed by the ALC plates are provided, respectively. The fireproof covering materials 36 fill gaps between these ALC plates.

The fireproof covering materials 36 fill gaps between the outer wall panels 23 formed by the ALC plates and the outer wall steel plate panels 18 and between the fireproof boundary wall panels 19 formed by the ALC plates and the outer wall steel plate panels 18.

Therefore, it is possible to satisfy a fireproof performance regulated in a strict standard for buildings, especially an apartment house, and to provide a sufficient thermal insulation performance between inside and outside of the unit building U and between the rooms 28 in the unit building U.

The method for constructing the unit building according to the embodiment, is configured by removing the temporary reinforcing members 2, 2 from the temporary reinforcing member equipped building unit 1 according to the embodiment, which is loaded on the loading platform of the semi-trailer 5 for a container as the transport means, and then hoisting the building unit body 1A from both short side surfaces by the cranes 6, 6 while maintaining a balance, transferring to a position where a groundwork of a building site is provided, building-up and assembling the building unit bodies 1A to construct the unit building U.

Due to such a configuration, when the unit building U especially having a medium-scale or more such as an apartment house is constructed, the building unit body 1A can be transferred in a stable state while being substantially horizontally maintained. Accordingly, it is possible to reduce a construction period with high construction efficiency.

As described above, although the preferred embodiment according to the present invention is described in detail with reference to drawings, the specific configurations are not limited thereto and modifications or changes in the design within scope of the subject matter may be included in the present invention.

For example, in the above described embodiment, the unit building U is constructed by using twenty temporary reinforcing member building units 1 as a 5-story building. However, it is not limited thereto and various designs may be used.

Furthermore, in the above described embodiment, the temporary reinforcing member 2 where the braces 22, 22 are erected between the reinforcing columns 21, 21 disposed at both of the left and right ends of the short side surface of the building unit body 1A. However, it is not limited thereto.

For example, as the temporary reinforcing member 2, a flat plate-like member may be used, which is slightly larger than the short side surface of the building unit body 1A.

Furthermore, although as the columns 7 and the beams 8 of the building unit body 1A, the H-shaped steels are used, it is not limited thereto. For example, channel steels may be used.

The present application is based on and claims priority from Japanese Application Number 2008-250545, filed on Sep. 29, 2010, the disclosure of which is hereby incorporated by reference herein in its entirety.

The invention claimed is:

1. A building unit with temporary reinforcing members configured to be transported by a trailer having a gooseneck, the building unit comprising:

a building unit body made of columns and beams connected to each other at each end and forming a box shape, the box shape of the building unit body having two short sides; and temporary reinforcing members formed of reinforcing columns detachably provided on left and right ends of the two short sides of the building unit body and a lower beam, each of the reinforcing columns having a projecting portion which projects downwardly from a lower end of the reinforcing column to support the building unit body, wherein the temporary reinforcing members are configured to detachably connect to the building unit body such that during transportation by the trailer having the gooseneck, the building unit body is supported on the gooseneck by the lower beam at a front side of the building unit body, and the building unit body is supported by the projection portions of the reinforcing columns at a rear side of the building unit body.

2. The building unit of claim 1, wherein the temporary reinforcing members have hook portions for a hoist.

3. The building unit of claim 1, wherein the temporary reinforcing members have hook portions for transport fixation.

4. The building unit of claim 1, further comprising braces erected between the reinforcing columns.

5. The building unit of claim 1, wherein the lower beam is disposed between the reinforcing columns of one of the reinforcing members at a position lower than a bottom surface of the building unit body.

6. The building unit of claim 5, wherein the temporary reinforcing members have hook portions for a hoist.

7. The building unit of claim 5, wherein the temporary reinforcing members have hook portions for transport fixation.

8. The building unit of claim 5, further comprising braces erected between the reinforcing columns.

9. The building unit of claim 5, wherein the building unit body has long sides adjacent to the short sides, and one of the long sides has an opening for a door, wherein the building unit further comprising a detachable temporary reinforcing cross brace disposed at the opening.

10. A building formed of a plurality of the building units of claim 5, wherein the temporary reinforcing members are detached from each of the building unit bodies.

11. The building of claim 10, wherein the plurality of building unit bodies are horizontally arranged and are vertically stacked, and wherein the building unit bodies are connected to each other using pin connections and composite connections, and the pin connections and composite connections are configured and arranged such that a connection strength between building unit bodies increases as floor level decreases.

12. The building unit of claim 1, wherein the building unit body has long sides adjacent to the short sides, and one of the long sides has an opening for a door, wherein the building unit further comprising a detachable temporary reinforcing cross brace disposed at the opening.

13. A building formed of a plurality of the building units of claim 1, wherein the temporary reinforcing members are detached from each of the building unit bodies.

14. The building of claim 13, wherein the plurality of bodies are horizontally arranged and are vertically stacked, and wherein the building unit bodies are connected to each other using pin connections and composite connections, and the pin connections and composite connections are configured and arranged such that a connection strength between building unit bodies increases as floor level decreases.

15. The building unit of claim 1, wherein the lower beam extends between the reinforcing columns of one of the reinforcing members at a position lower than a bottom surface of the building unit body, and wherein the lower beam is disposed between the building unit body and the projecting portions of the reinforcing columns.

16. A building formed from a plurality of building units, each of the building units comprising:

(i) a building unit body made of columns and beams connected to each other at each end and forming a box shape, the box shape of the building unit body having two short sides; and (ii) temporary reinforcing members formed of reinforcing columns detachably provided on left and right ends of the two short sides of the building unit body, each of the reinforcing columns having a lower end and a projecting portion which projects downwardly from the lower end, wherein the building further comprises an overhang member attached to one of the short sides of each of the building unit bodies, the overhang member having a width narrower than the one short side, wherein the building further comprises a corner outer wall panel attached on an outwardly directed corner portion of each of the building unit bodies.

17. The building of claim 16, further comprising a decorative member attached between each overhang member and a respective outer wall panel of each of the building unit bodies and between the overhang members, respectively, wherein a vacant space is formed in the decorative members.

18. A building formed from a plurality of building units, each of the building units comprising:

(i) a building unit body made of columns and beams connected to each other at each end and forming a box shape, the box shape of the building unit body having two short sides; and (ii) temporary reinforcing members formed of reinforcing columns detachably provided on left and right ends of the two short sides of the building unit body, each of the reinforcing columns having a lower end and a projecting portion which projects downwardly from the lower end, wherein the building further comprises an overhang member attached to one of the short sides of each of the building unit bodies, and the overhang member forms a cantilever supported balcony or a cantilever supported passage.

19. A method of transporting a building unit with a trailer having a gooseneck, the method comprising:

disposing a building unit on a trailer having a gooseneck, the building unit including i. a building unit body made of columns and beams connected to each other at each end and forming a box shape, the box shape of the building unit body having two short sides, and ii. temporary reinforcing members formed of reinforcing columns detachably provided on left and right ends of the two short sides of the building unit body and a lower beam, each of the reinforcing columns having a projecting portion which projects downwardly from a lower end of the reinforcing column to support the building unit body, iii. wherein the temporary reinforcing members are configured to detachably connect to the building unit body; and transporting the building unit with the trailer having the gooseneck while supporting a front side of the building unit body on the gooseneck with the lower beam and supporting a rear side of the building unit body with the projection portions of the reinforcing columns.

20. The method of claim 19, wherein the lower beam extends between the reinforcing columns of one of the reinforcing members at a position lower than a bottom surface of the building unit body, and during said transporting the lower beam is disposed between the building unit body and the gooseneck of the trailer.

* * * * *